US010138667B2

(12) United States Patent
Graul et al.

(10) Patent No.: US 10,138,667 B2
(45) Date of Patent: Nov. 27, 2018

(54) SPRING AND/OR DAMPING ELEMENT

(71) Applicants: Urs-Peter Graul, Kirchheim/Teck (DE); Hans Christoph Intelmann, Weissach (DE); Ismail Bahadir Pamir, Ostfildern (DE)

(72) Inventors: Urs-Peter Graul, Kirchheim/Teck (DE); Hans Christoph Intelmann, Weissach (DE); Ismail Bahadir Pamir, Ostfildern (DE)

(73) Assignee: HAHN GASFEDERN GMBH, Aichwald (DE)

( * ) Notice: Subject to any disclaimer, the term of this patent is extended or adjusted under 35 U.S.C. 154(b) by 250 days.

(21) Appl. No.: 15/059,762

(22) Filed: Mar. 3, 2016

(65) Prior Publication Data

US 2016/0258199 A1 Sep. 8, 2016

(30) Foreign Application Priority Data

Mar. 3, 2015 (DE) ..... 10 2015 203 812

(51) Int. Cl.
*E05F 5/00* (2017.01)
*E05F 5/02* (2006.01)
*E05F 1/16* (2006.01)

(52) U.S. Cl.
CPC ..... *E05F 5/003* (2013.01); *E05F 1/16* (2013.01); *E05F 5/027* (2013.01);
(Continued)

(58) Field of Classification Search
CPC ..... E05F 1/16; E05F 5/003; E05F 3/00; E05F 3/04; E05F 3/14; E05F 5/02;
(Continued)

(56) References Cited

U.S. PATENT DOCUMENTS 5,393,137 A * 2/1995 Bivens ..... B60N 3/083 296/37.9
8,590,989 B2 * 11/2013 Lowe ..... A47B 88/047 312/319.1
2009/0273263 A1 * 11/2009 Berger ..... A47B 88/467 312/334.1

(Continued)

FOREIGN PATENT DOCUMENTS

CN 102979394 B 3/2013
DE 19803790 A1 8/1999

(Continued)

OTHER PUBLICATIONS

Office Action issued by SIPO (PRC), dated Sep. 7, 2018, re Chinese Appln. 201610223538.8.

*Primary Examiner* — Mark A Williams
(74) *Attorney, Agent, or Firm* — Fitch, Even, Tabin & Flannery, LLP

(57) ABSTRACT

A damper element for damping a translational movement of a component and for causing the component to stop at a stop position includes a housing, a carrier displaceably supported in the housing for movement in a translational direction, and a damper part for damping the translational movement. The damper part has a first end connected to the housing and a second end pivotably connected to the carrier, the carrier is pivotable about a pivot axis perpendicular to the translation direction between a first position and a second position, and the damper element further includes at least one spring biasing the carrier toward the first position.

17 Claims, 3 Drawing Sheets

(52) U.S. Cl.
CPC ..... *E05Y 2201/48* (2013.01); *E05Y 2201/622* (2013.01); *E05Y 2800/24* (2013.01)

(58) Field of Classification Search
CPC ..... A47B 2210/0094; A47B 88/40; A47B 2210/0018; E05Y 2800/24; E05B 17/0041; E05B 2015/0493; E05B 17/0045
See application file for complete search history.

(56) References Cited

U.S. PATENT DOCUMENTS

| | | | | |
|---|---|---|---|---|
| 2010/0176700 | A1* | 7/2010 | Perez | A47B 88/467<br>312/334.8 |
| 2011/0023370 | A1* | 2/2011 | Zimmer | E05F 1/16<br>49/360 |
| 2011/0167588 | A1* | 7/2011 | Chang | E05F 5/003<br>16/71 |
| 2013/0028544 | A1* | 1/2013 | Lowe | A47B 88/047<br>384/21 |
| 2014/0294328 | A1* | 10/2014 | Pecar | A47B 88/04<br>384/20 |
| 2015/0374125 | A1* | 12/2015 | Goetz | A47B 88/463<br>312/319.1 |
| 2016/0076288 | A1* | 3/2016 | Bantle | E05F 1/16<br>49/417 |

FOREIGN PATENT DOCUMENTS

| | | | |
|---|---|---|---|
| DE | 202007014548 | U1 | 11/2008 |
| EP | 1076147 | A2 | 2/2001 |
| EP | 1961332 | A1 | 8/2008 |

* cited by examiner

SPRING AND/OR DAMPING ELEMENT

CROSS-REFERENCE

This application claims priority to German patent application no. 10 2015 203 812.2 filed on Mar. 3, 2015, the contents of which are fully incorporated herein by reference.

TECHNOLOGICAL FIELD

The disclosure is directed to a spring and/or damper element for springing and/or damping a translational movement of a component, such as a door or a window, and for causing the component to stop safely at a stop position, and, more particularly, to a spring and/or damper element including a housing part, a carrier supported for translational movement in the housing part, and a spring and/or damper-part for springing and/or damping the translational movement and for causing the component to stop safely at a stop position.

BACKGROUND

It is known to use spring and/or damper elements of the above-mentioned type to help ensure that displaceable components like doors and windows slide gently or softly into an end position. Drawers that need to be guided softly into a closed position are another example of a displaceable component that may be damped. To accomplish such damping, an activator is disposed on the movable component (that is, the component that is to be damped) which activator is configured to engage the carrier so that the damper element can brake the component. However, if the carrier is not properly installed, the activator may strike the carrier in a manner that could damage or destroy the activator.

This problem has been addressed in the past by manufacturing carriers from relatively soft and compliant materials. Then, if an activator strikes the carrier, the compliant carrier will yield by deforming and thus avoid damage to the activator.

The use of carriers formed from compliant materials is disadvantageous under certain circumstances. For example, when very heavy components (doors or windows up to 400 kg) are to be damped, the deformability of the carrier interferes with the required functionality. This problem emerges in particular as soon as the components to be damped exceed a weight of 90 kg. Carriers formed from compliant materials can also cause problems when an activator impacts a carrier at high speed.

SUMMARY

One aspect of the disclosure is to improve a damper element of the above-mentioned type in order to avoid damage to the activator in case of a collision with the carrier even if the carrier is formed of solid or rigid material (in other words, not compliant material as previously used). This may allow for more effective damping of heavy components, including windows and doors, to allow them to come gently to rest in a desired end position.

The damper element of the disclosure includes a pivotably mounted carrier and at least one spring (or spring device or spring means) that is configured to push or preload the carrier, at least over a section of its translational displacement movement, in a pivotal direction into one of its pivoted end positions.

The spring device is preferably embodied from at least one leaf spring that can be deformed by at least one actuating pin on the carrier. The spring device, in particular the leaf spring, can be disposed at an edge region of a—preferably rectangular—recess that is incorporated in the housing part. Preferably one leaf spring is disposed on each of the two sides of the carrier.

The housing is preferably comprised of a first and a second housing part, in particular of two housing halves.

The damper part of the damper element is preferably a gas spring.

Using at least one guide block the carrier can be disposed in a linearly displaceable manner in a groove in the housing, which groove extends in the translational direction.

Furthermore, viewed towards the pivot axis the carrier preferably has a U-shaped design. It can also include a V-shaped recess for a rod-shaped part of the damper element to pass through. The V-shape of the recess allows the rod-shaped part to move through the recess in a longitudinal or translational direction regardless of the pivot position (angular orientation) of the carrier.

The housing can include at least one attachment element, in particular an attachment flange, that is connected to the rest of the housing via a predetermined break point.

The present disclosure thus includes a (preferably two-part) housing (including upper and lower housing halves) in which a gas spring is housed which spring can translationally displace or dampen the carrier.

The disclosed damping device is particularly useful for damping relatively heavy doors and windows, and allows weights of up to at least 400 kg to be safely damped.

Another embodiment of the disclosure comprises a damper element for damping a translational movement of a component and for causing the component to stop at a stop position. The damper element comprises a housing, a carrier displaceably supported in the housing for movement in a translational direction, and a damper part for damping the translational movement. The damper part has a first end connected to the housing and a second end pivotably connected to the carrier, and the carrier is pivotable about a pivot axis perpendicular to the translation direction between a first position and a second position. The damper element further includes at least one spring biasing the carrier toward the first position.

In some embodiments, the carrier includes a wall oblique to the translational direction. In some embodiments, the carrier includes a first notch adjacent to the wall. In some embodiments, the carrier includes a second notch having converging notch walls, the rod extending through the second notch. In some embodiments, the carrier includes at least one actuating pin in contact with the at least one spring.

The carrier, which preferably has a U-shaped design, is pivotably connected to the piston rod of the gas spring. Therefore, if an activator impacts against one arm or flank region of the carrier, the carrier can pivot out of the way to avoid high forces between activator and the carrier. For this purpose the outside of the flank region or the outside of an arm of the U-shaped structure of the carrier can be configured to make an oblique angle with the translational direction to enable the carrier to pivot so that high impact forces are not experienced by the activator.

When such a pivoting movement occurs, the actuation pins disposed on the two sides of the carrier, i.e., on the upper and lower end sides of the carrier, press the disclosed spring devices, which may comprise two leaf springs, out of their rest position, so that when the force from the activator impact is over the carrier can pivot back into its original position.

Accordingly, upon impact of the activator the one flank of the U-shaped structure of the carrier can "submerge" by pivoting, and upon the discontinuation of the impact force, the carrier can pivot back into its rest position under the force from the spring device. In this manner, damage to the carrier may be prevented.

Accordingly the damper element can be positioned in either of its end positions without the carrier being be damaged by an impact from an activator. This may also be advantageous when adjusting the damper element during installation.

A further advantage of the disclosed design is that the above-mentioned configuration of the damper element makes modular installation possible due to easily removable (via a predetermined break point) attachment straps. This makes the installation of the damper element easier. In the conventional art different embodiments of the damper element are often necessary depending on the side from which the element is to be installed.

A safe and reliable braking or damping of even heavy components (windows, doors, and drawers up to 400 kg) is thus advantageously also possible without damage to the damper element and in particular to the carrier.

Adjusting the damper element during installation is made easier in the same manner. Finally it is advantageous that the installation possibilities of the damper element are universal, since unnecessary attachment elements can be easily removed via a predetermined break point.

BRIEF DESCRIPTION OF THE DRAWINGS

An exemplary embodiment of the disclosure is depicted in the drawings.

DETAILED DESCRIPTION

Figure 1:
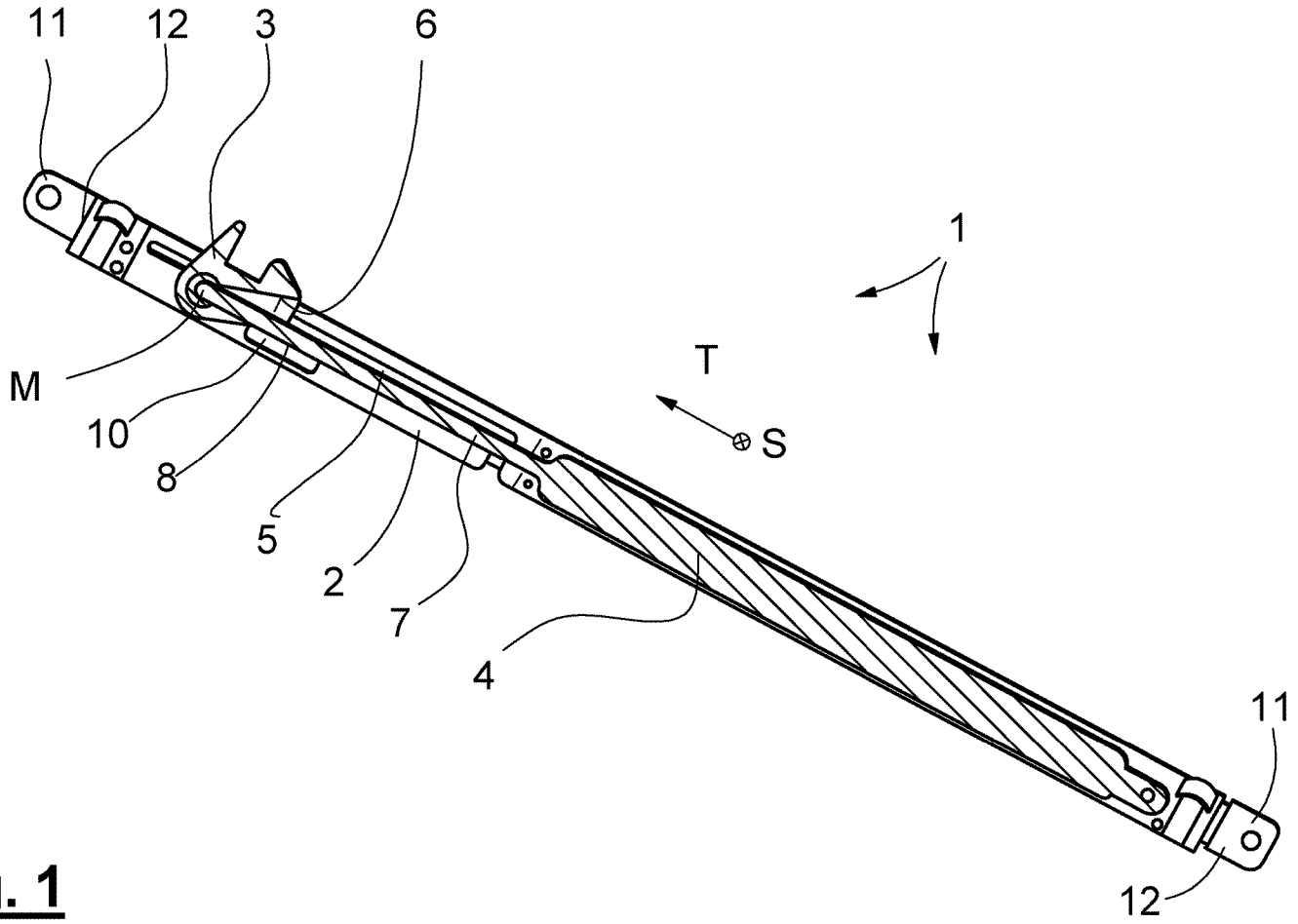
FIG. 1 is a top plan view, partly in section, of a spring and/or damper element according to the disclosure that includes a gas spring and a carrier.

The figures illustrate a spring and/or damper element 1 (sometimes referred to as a damper element) that can function to brake a component, such as a door or a drawer or a window, which is displaceable in a translational direction T, and guide the component into an end position in a damped manner. For this purpose the spring and/or damper element 1 includes a housing 2 (in the present case comprised of an upper and lower housing half) and a spring and/or damper-part in the form of a gas spring 4 disposed in the housing. The gas spring 4 is fixedly connected to the housing by a first (right) end. The gas spring 4 is connected to a carrier 3 by a second (left) end, i.e., by the end of a rod-shaped part 7 (piston rod).

A groove 5 is incorporated in the housing 2, i.e., both in the lower and in the upper housing part, which groove 5 extends in the translational direction T. Accordingly the carrier 3 can slide in the housing 2 in the translational direction T, which movement is damped because the carrier 3 is connected to the gas spring 4.

Figure 3:
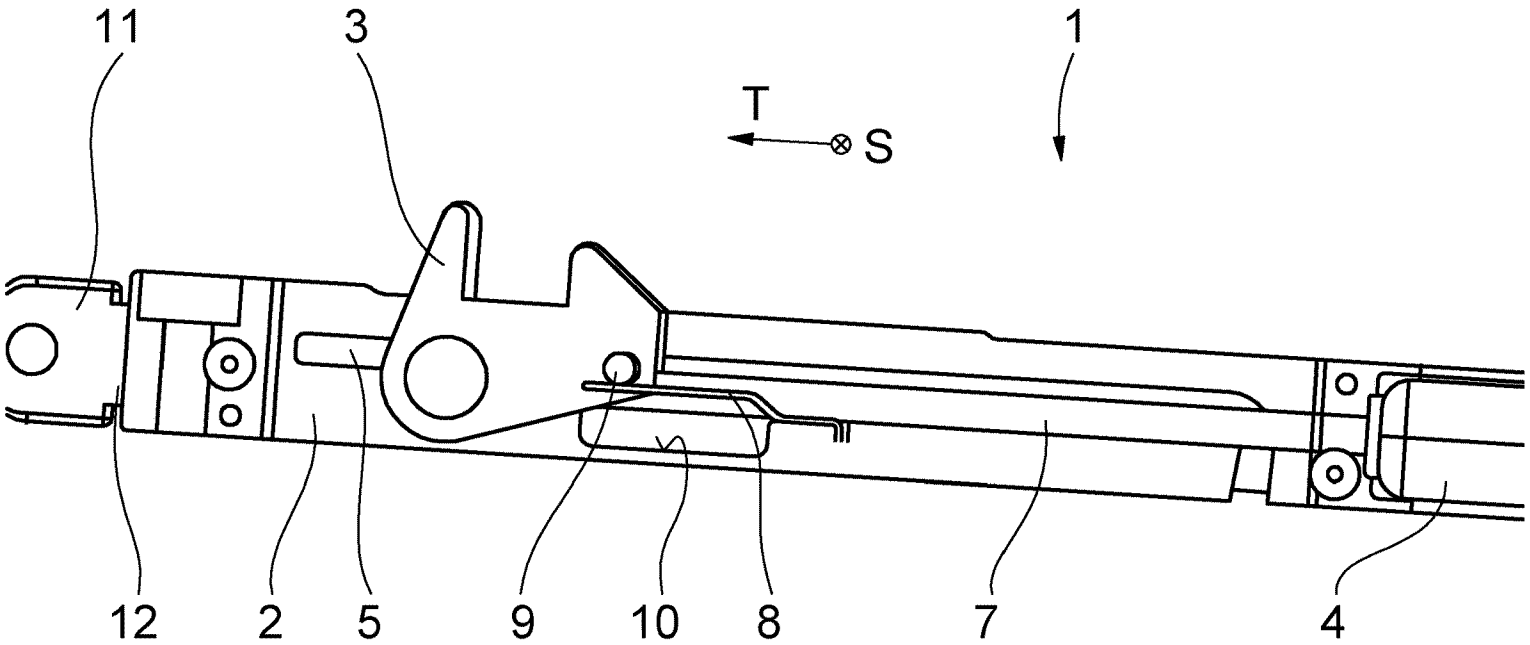
FIG. 3 is a top plan view of the left region of the spring and/or damper element of FIG. 1.

As can best be seen from FIG. 3, the carrier 3 comprises an essentially U-shaped structure made of a relatively hard material. In the event of an impact from an activator (not illustrated) disposed on a component that is to be damped, the following benefits are obtained.

The carrier 3 is pivotably connected to the end of the gas spring 4, i.e., namely to the piston rod 7 itself and is supported in the housing 2 such that it can pivot about a pivot axis S perpendicular to the translational direction T. The pivot point of this pivot axis is indicated in FIG. 1 by the letter M.

Figure 2:
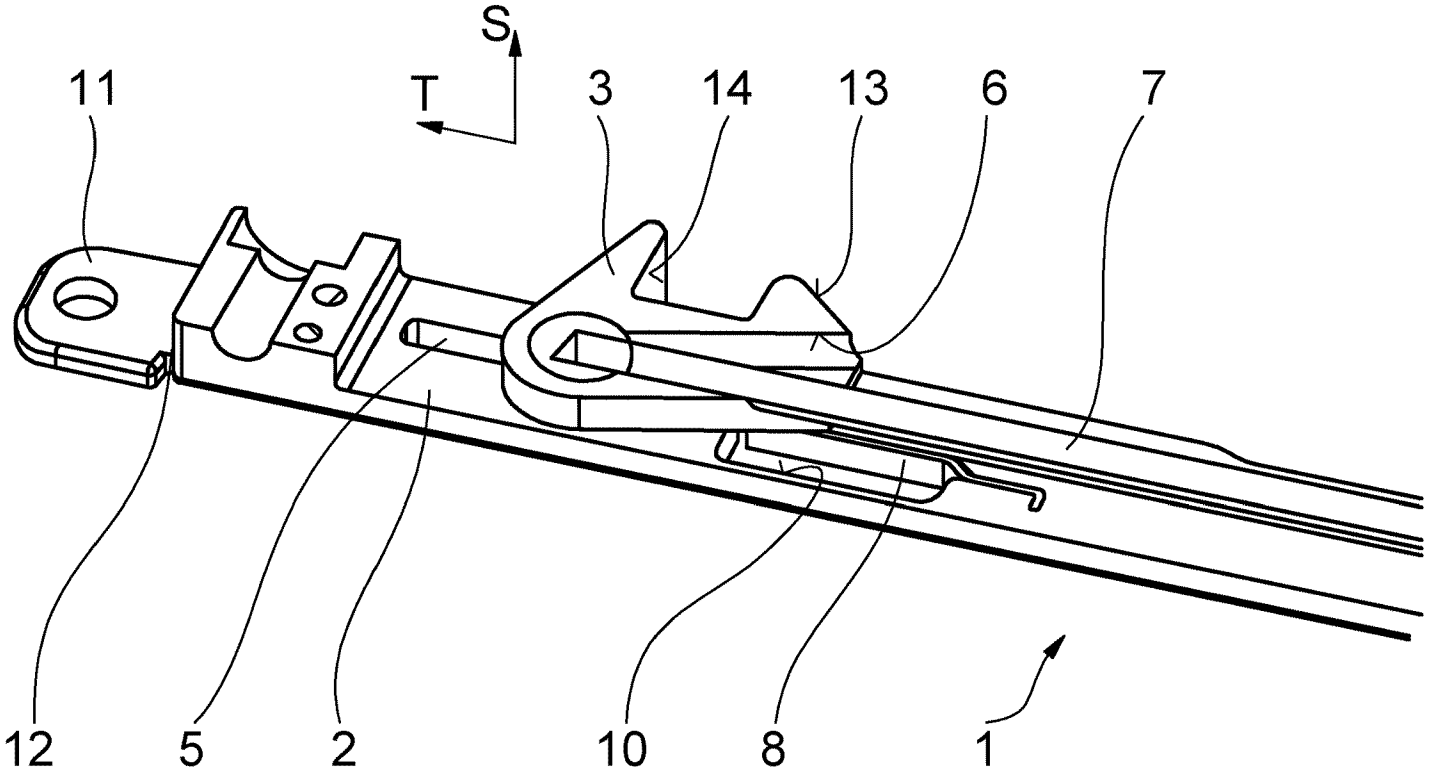
FIG. 2 is an enlarged perspective view of the left region of the spring and/or damper element of FIG. 1.

The piston rod 7 enters into the carrier 3 over a long extension thereof, as can best be seen in FIG. 2 and in the translational direction. A V-shaped groove 6 (a groove having converging side walls) is provided in the carrier 3 which groove 6 allows the piston rod 7 to move when the carrier 3 pivots about the pivot axis S. The shape of the groove 6 defines the angle through which the carrier 3 can rotate about the pivot axis S. In the exemplary embodiment, this angle is approximately 20°.

Thus if an activator of a component to be braked impacts against the flank surface 13 (see FIG. 2) of the carrier 3, the carrier 3 will pivot about the pivot axis S. In other words, the arm that includes the flank surface 13 will shift or submerge below the activator so that damage to the carrier 3 and/or to the activator can be avoided.

Actuating pins 9 are disposed on the carrier 3, one actuating pin 9 on the upper side and one actuating pin 9 on the lower side of the carrier 3. One of the actuating pins 9 is visible in FIG. 3. When the carrier 3 pivots about the pivot axis S, the spring devices 8, in this embodiment two leaf springs, are deformed. The configuration of the spring devices 8 is best seen in FIGS. 2 and 3. The spring devices 8 are disposed over a recess 10 in the housing 2 and are connected at one of their axial ends to the housing 2 (see FIG. 3: right end of the leaf spring 8).

Accordingly when the carrier 3 pivots about the pivot axis S, it elastically deforms and loads the spring device 8. The spring devices 8 produce a restoring force to shift the carrier 3 back toward the position of the carrier 3 illustrated in the Figures.

Thus when an activator on a component to be damped impacts on the flank surface 13, the carrier 3 pivots as described above. With further movement of the activator (towards the left in the Figures) it reaches and impacts against the flank surface 14 (see FIG. 2) of the carrier 3 and thus moves the carrier 3 back into its original position. This return movement is also aided by the spring device 8.

Attachment elements 11 are provided on the axial ends of the spring and/or damper element 1 for attaching the housing 2 to an adjacent component. These attachment elements 11 of this embodiment are flange-type components that can be fixed using an attachment screw. If the spring and/or damper element 1 is installed such that fixation is only necessary on an axial end region, the unneeded attachment element 11 can be broken off, i.e., removed, at a predetermined break point 12.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved spring and/or damping elements.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

1 Spring and/or damper element
2 Housing
3 Carrier
4 Spring and/or damper part
5 Groove
6 V-shaped recess
7 Rod-shaped part of the spring and/or damper-part
8 Spring device
9 Actuating pin
10 Recess
11 Attachment element
12 Predetermined break point
13 Flank surface
14 Flank surface
T Translational direction
S Pivot axis
M Pivot point

What is claimed is:

1. A damper element for damping a translational movement of a component and for causing the component to stop at a stop position, the damper element comprising a housing, a carrier displaceably supported in the housing for movement in a translational direction, and a damper part for damping the translational movement, wherein the damper part has a first end connected to the housing and a second end pivotably connected to the carrier, wherein the carrier is pivotable about a pivot axis perpendicular to the translation direction between a first position and a second position, wherein the damper element further includes at least one leaf spring connected to bias the carrier toward the first position, and wherein the carrier includes at least one actuating pin configured to deform the at least one spring when the carrier pivots from the first position to the second position.

2. The damper element according to claim 1, wherein the at least one leaf spring is disposed on a side region of a recess in the housing.

3. The damper element according to claim 1, wherein the at least one leaf spring comprises a first leaf spring disposed on a first side of the carrier and a second leaf spring disposed on a second side of the carrier.

4. The damper element according to claim 1, wherein the housing comprises a first housing half connected to a second housing half.

5. The damper element according to claim 1, wherein the damper part comprises a gas spring.

6. The damper element according to claim 1, wherein the carrier includes a portion guided in a linear groove in the housing, the groove extending in the translational direction.

7. The damper element according to claim 1, wherein the carrier has a U-shaped design viewed in the direction of the pivot axis.

8. The damper element according to claim 1, wherein the carrier includes a V-shaped recess, wherein the damper part includes a gas spring having a projecting rod extending through the V-shaped recess, and wherein the V-shaped recess is configured to allow the carrier to pivot from the first position to the second position.

9. The damper element according to claim 1, wherein the housing includes at least one attachment element connected to the housing via a predetermined break point.

10. A damper element damper element for damping a translational movement of a component and for causing the component to stop at a stop position, the damper element comprising a housing, a carrier displaceably supported in the housing for movement in a translational direction, and a damper part for damping the translational movement, wherein the damper part has a first end connected to the housing and a second end pivotably connected to the carrier, wherein the carrier is pivotable about a pivot axis perpendicular to the translation direction between a first position and a second position, wherein the damper element further includes at least one spring connected to bias the carrier toward the first position, wherein the carrier includes at least one actuating pin configured to deform the at least one spring when the carrier pivots from the first position to the second position, wherein the at least one spring comprises a first leaf spring disposed on a first side of the carrier and a second leaf spring disposed on a second side of the carrier, wherein the housing comprises a first housing half connected to a second housing half, wherein the damper part comprises a gas spring, wherein the carrier includes a portion guided in a linear groove in the housing, the groove extending in the translation direction, wherein the carrier is U-shaped in design viewed in the direction of the pivot axis and includes a V-shaped recess, wherein the gas spring includes a projecting rod extending through the V-shaped recess, and wherein the V-shaped recess is configured to allow the carrier to pivot from the first position to the second position.

11. A damper for damping translational movement of a component, the damper comprising a housing, a carrier displaceably supported in the housing for movement in a translational directtion, and a gas spring for damping the translational movement, the gas spring comprising a cylinder having a first end connected to the housing and a rod projecting from a second end of the cylinder, an end of the rod being pivotably connected to the carrier, wherein the carrier is pivotable about a pivot axis perpendicular to the translation direction between a first and a second position, and wherein the damper further includes at least one leaf spring configured to bias the carrier toward the first position.

12. The damper according to claim 11, wherein the carrier includes a wall oblique to the translational direction.

13. The damper according to claim 12, wherein the carrier includes a first notch adjacent to the wall.

14. The damper according to claim 13, wherein the carrier includes a second notch having converging notch walls, the rod extending through the second notch.

15. The damper according to claim 14, wherein the carrier includes at least one actuating pin in contact with the at least one spring.

16. The damper element according to claim 1, wherein the at least one leaf spring is connected at one axial end to the housing.

17. The damper element according to claim 16, wherein the carrier has an actuating pin and the other axial end of the at least one leaf spring engages the actuating pin.

* * * * *